United States Patent [19]

Kleinklaus

[11] Patent Number: 4,906,046

[45] Date of Patent: Mar. 6, 1990

[54] STACKABLE CHAIR WITH FOLDABLE BACK AND ARM RESTS

[75] Inventor: Norbert Kleinklaus, Vaux Les Saint Claude, France

[73] Assignee: Grosfillex S.A.R.L. (Societe A Responsabilite Limitee), Oyonnax, France

[21] Appl. No.: 315,534

[22] Filed: Feb. 24, 1989

[30] Foreign Application Priority Data

Mar. 2, 1988 [FR] France ..... 88 02653

[51] Int. Cl.[4] ..... A47C 3/04

[52] U.S. Cl. ..... 297/359; 297/239

[58] Field of Search ..... 297/359, 378, 379, 417, 297/420, 421, 239

[56] References Cited

U.S. PATENT DOCUMENTS

| | | | |
|---|---|---|---|
| 2,916,086 | 12/1959 | Panicci | 297/359 |
| 2,920,686 | 1/1960 | Thomas | 297/359 X |
| 4,674,793 | 6/1987 | Kettler | 297/359 X |
| 4,749,232 | 6/1988 | Guichon | 297/359 |
| 4,784,432 | 11/1988 | Brown | 297/359 |

FOREIGN PATENT DOCUMENTS

| | | |
|---|---|---|
| 2391680 | 5/1977 | France . |
| 2579435 | 10/1986 | France . |
| 1404527 | 9/1975 | United Kingdom . |

*Primary Examiner*—Peter A. Aschenbrenner
*Attorney, Agent, or Firm*—Pravel, Gambrell, Hewitt, Kimball & Krieger

[57] ABSTRACT

The chair comprises both a seat (1) supported by pairs of legs (2) interconnected by top ties (3) and a back (4) which is pivotally mounted to the seat about pins (11), together with arm rests (12) resting on the ties (3) and hinged to the back (4). Each arm rest (12) is hinged to the back (4) by a hinge device disposed behind the back and comprising a bearing (25) holding a ball (23) formed with the arm rest and offset laterally therefrom, with the bearing having a transverse slot (31) for enabling said arm rest to pass from side to side of a riser member (5) of said back.

5 Claims, 6 Drawing Sheets

FIG. 5
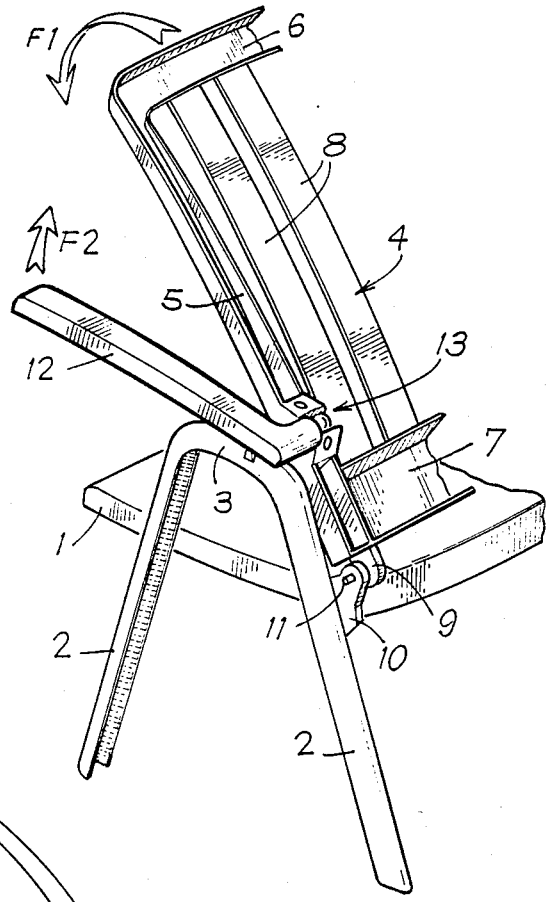
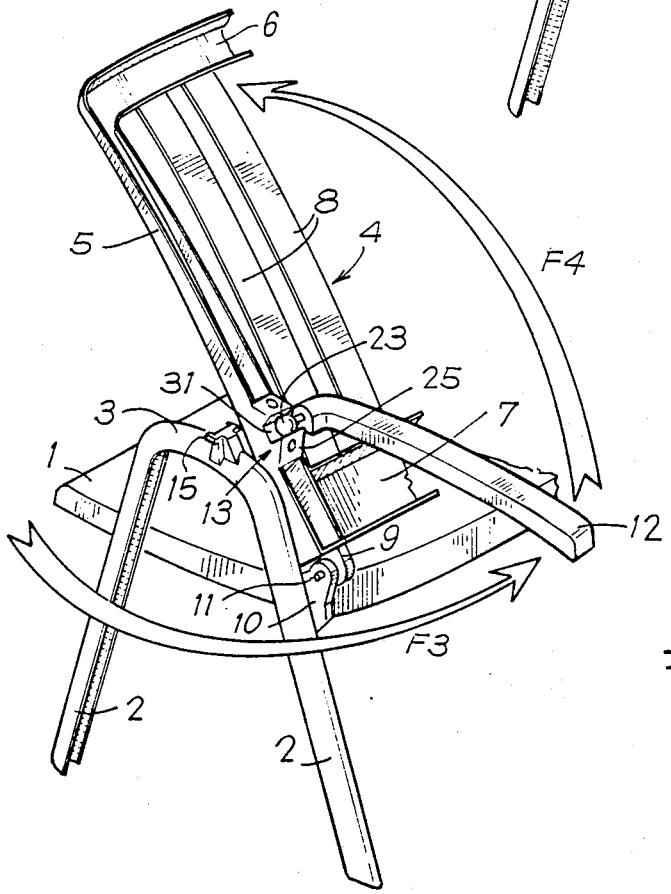
FIG. 6

STACKABLE CHAIR WITH FOLDABLE BACK AND ARM RESTS

The present invention relates to an indoor or outdoor chair comprising both a seat supported by two lateral pairs of legs extending above the seat to receive arm rests, and a back hinged at its base to the rear of the seat, and hinged higher up to the arm rests, with the arm rests being displaceable forwardly and backwardly in order to adjust the tilt of the back.

In order to enable identical chairs of this type to be stacked, it is necessary for their backs to be foldable onto their seats, and for their arm rests to be retractable.

BACKGROUND OF THE INVENTION

French Pat. No. 2 593 686 describes a stackable chair of this type. In this prior chair, the legs in each pair converge upwardly and are rigidly interconnected by a top tie in a stackable configuration. In addition, each arm rest resting on the corresponding tie is fixed thereto in removeable manner and is connected to the back by a hinge axis which is situated above the arm rest in question at a distance above the back-and-seat hinge axis which is chosen relative to the distance between said back-and-seat hinge axis and the front end of the above-mentioned corresponding tie, so that the rear end of the arm rest in question is capable of going past the front end of said tie when the back is folded onto the seat.

In addition, each arm rest contains a rack co-operating with a finger on the corresponding tie, which finger is held captive in the arm rest over its entire adjustment stroke for adjusting the tilt of the back, said arm rest having a bottom opening situated at the rear of the rack in order to allow the finger to escape when said arm rest is raised for the purpose of folding down the back.

Thus, prior to stacking, the arm rests are moved forwards, thereby tilting the back forwardly, after which the rests are raised and moved forwards in order to escape from the racks, after which they continue past the pairs of legs, thereby folding the back down onto the seat and simultaneously bringing the rear portions of the arm rests into abutment against said seat.

A drawback of this prior chair is that it occupies a relatively large amount of space when stacked since, in the folded position, the arm rests project a considerable distance from the remainder of the folded chair, i.e. the legs, the seat, and the back folded down on the seat. As a result, the packing density of trucks or other vehicles is limited, thereby increasing transport costs. Another result is that more room is required for storing stacks of chairs on user premises.

Another drawback of this prior chair is that the arm rests projecting beyond the stack of chairs are exposed and run the risk of being broken.

Another drawback of this prior chair is that said rear portion for raising the hinge axis connecting each arm rest to the back is unusual in appearance and seems not to appeal to customers.

British Pat. No. 1 404 527 also describes a stackable chair in which the back may be folded down onto the seat and in which the arm rests may be retracted.

In this other prior chair, each arm rest is connected to the back by a kind of universal joint disposed in front of the back. A horizontal axis of this universal joint allows the corresponding arm rest to be raised while a vertical axis of said joint allows a raised arm rest to be folded across the front of the back. When the arm rests are in this position, the back can be folded down onto the seat and stacking can take place.

The advantage of this other prior chair over the previously-described chair is that the arm rests do not project forwardly from the remainder of the chair when the back is folded down onto the seat. The packing density therefore appears to be improved.

However, stacking is poor and in any event unstable and relatively bulky since the arm rests occupy space between the back and the seat of each chair, thereby preventing the back from being folded right down since it abuts against the interposed arm rests.

The object of the present invention is to remedy the above drawbacks of these two prior chairs while retaining their advantages.

The invention also seeks to make it possible for the chair to be made of plastics material using a small number of components, and thus a small number of molds, and for it to be suitable for assembling easily and quickly without special skills and using a very small number of connecting shafts. This leads to low cost price and means that it can be sold through chain stores.

SUMMARY OF THE INVENTION

In order to achieve this aim, the invention implements a combination of the means disclosed in the two above-mentioned patents. In particular, the present invention provides a chair comprising both a seat supported on either side by respective pairs of legs extending above the seat and converging upwardly towards respective top leg-interconnecting ties for receiving corresponding arm rests which are displaceable longitudinally and which are adjustable in position by means of devices each comprising a rack and a stop finger, and also a back which is pivotally mounted relative to said seat, the back being also connected to each of two arm rests by respective two-axis hinge devices, each having a first axis extending substantially along a line of greatest slope of said back and a second axis substantially perpendicular to the first axis and parallel to the pivot axis of said back relative to the seat.

According to the invention, each hinge device is disposed behind the back and projects over a sufficient height to enable the corresponding arm rest to pass from an outside position relative to a margin member of the back to an inside position relative thereto by pivoting about said first axis, said hinge device being mounted on said margin member, said two positions being substantially 180° apart, and said arm rests being capable of pivoting, at least in each of said two positions, about the second axis, thereby enabling it in its outside position to engage on th corresponding tie between the legs when the back is raised, and in its inside position to press flat against the rear face of the back until the back rests against the seat.

In a particularly advantageous embodiment, in order to constitute each hinge device, the corresponding arm rest is formed with a rod projecting laterally in a direction which is substantially perpendicular to its longitudinal axis, said rod being terminated by a ball which is mounted to rotate about its own center in a bearing on the above-mentioned margin member of the back, said bearing delimiting a slot extending along the second above-mentioned axis so that the rod is guided, thereby limiting pivoting of the ball about the first axis, whereas the sides of said bearing are suitable for co-operating with the corresponding side of the arm rest under consideration by coming into abutment therewith, thereby limiting pivoting of the ball about the second axis.

BRIEF DESCRIPTION OF THE DRAWINGS

An embodiment of the invention is described by way of example with reference to the accompanying drawings, in which:

FIGS. 5 to 7 are perspective half-views showing the chair from behind during successive stages while the chair is being folded;

DETAILED DESCRIPTION

Figure 1:
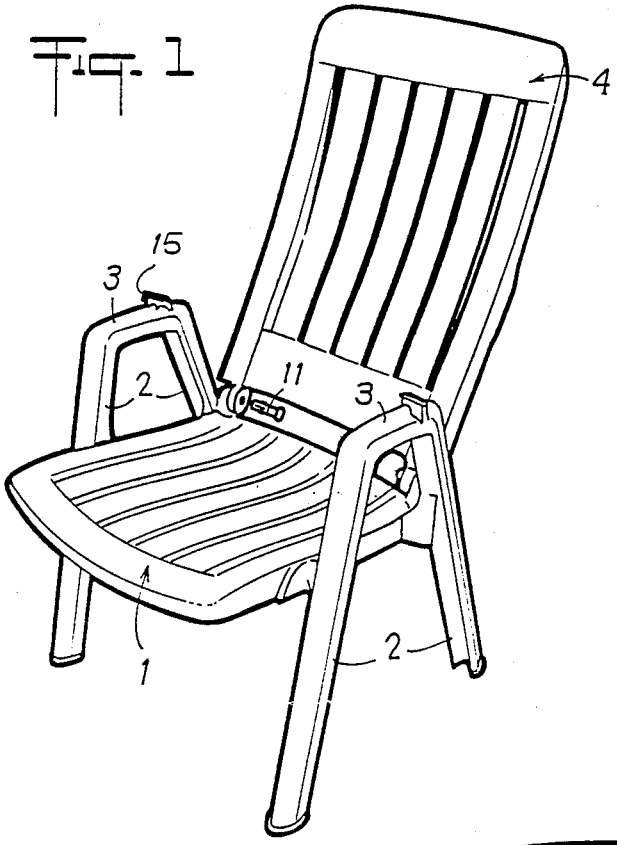
FIG. 1 is a perspective view of a chair in accordance with the invention, with the back of the chair shown in an inuse position.
Figure 2:
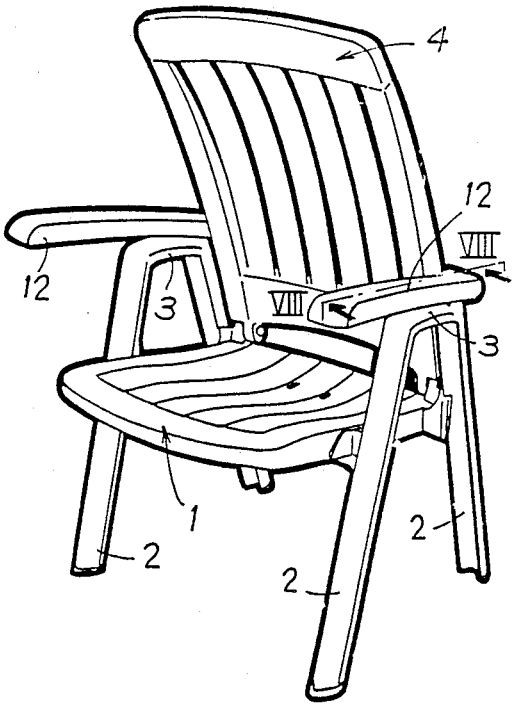
FIG. 2 is a view analogous to FIG. 1, showing the chair at the beginning of a folding operation.
Figure 3:
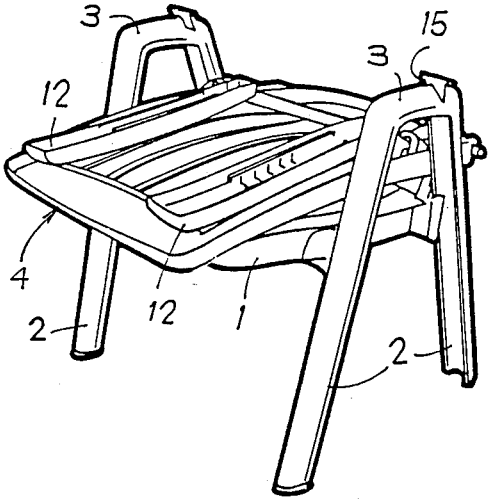
FIG. 3 is a view similar to FIG. 1, showing said chair when folded down and prior to stacking.
Figure 4:
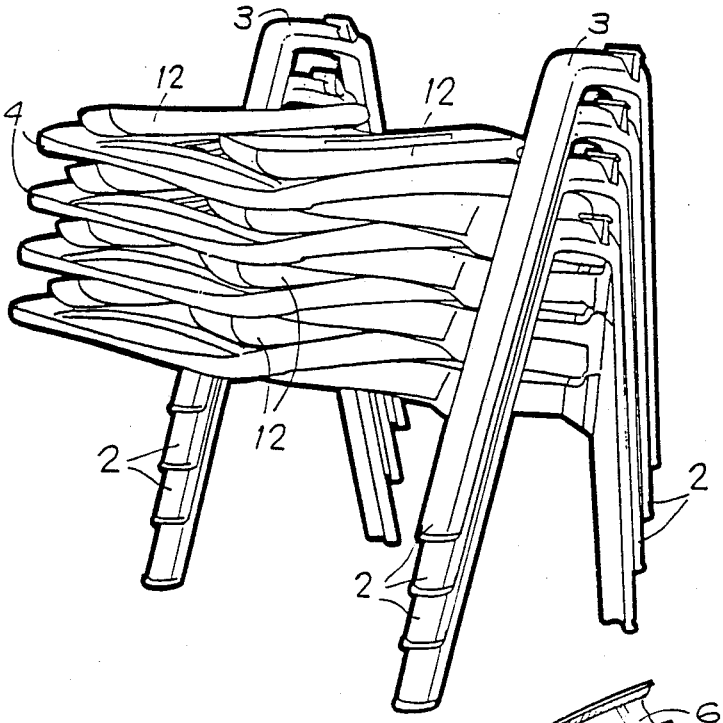
FIG. 4 is a perspective view of a stack of folded chairs as shown in FIG. 3.

As can be seen in FIGS. 1 to 4, a chair comprises a seat 1 molded in plastics material integrally with two side pairs of legs 2, with the legs in each pair converging upwardly and extending above said seat up to a tie 3 which interconnects them. This one-piece part-chair is molded in such a manner as to enable a plurality of such identical items to be stacked (see FIG. 4).

The chair also includes a back 4 made of plastic material and unmolded from the rear. The back comprises margin members or side risers 5 interconnected by a top cross-member 6 and a bottom cross-member 7 with vertical slats 8 extending therebetween. The slats 8 are not as thick as said items 5 to 7 which are in the form of channel section members open to the rear.

Lugs 9 project from the bottom ends of the risers 5 of the back 4, said lugs being disposed against lugs 10 which project upwardly from the rear end of the sides of the seat 1, with pairs of lugs 9 and 10 being interconnected by pivot pins 11 dsposed in alignment.

Finally, the chiar includes two arm rests 12 which rest on the ties 3 between the pairs of legs 2 and are adjustable in position thereon in a forwards and backwards direction, with the rear ends of the arm rests being connected to the risers 5 of the back by hinge devices 13.

Figure 8:
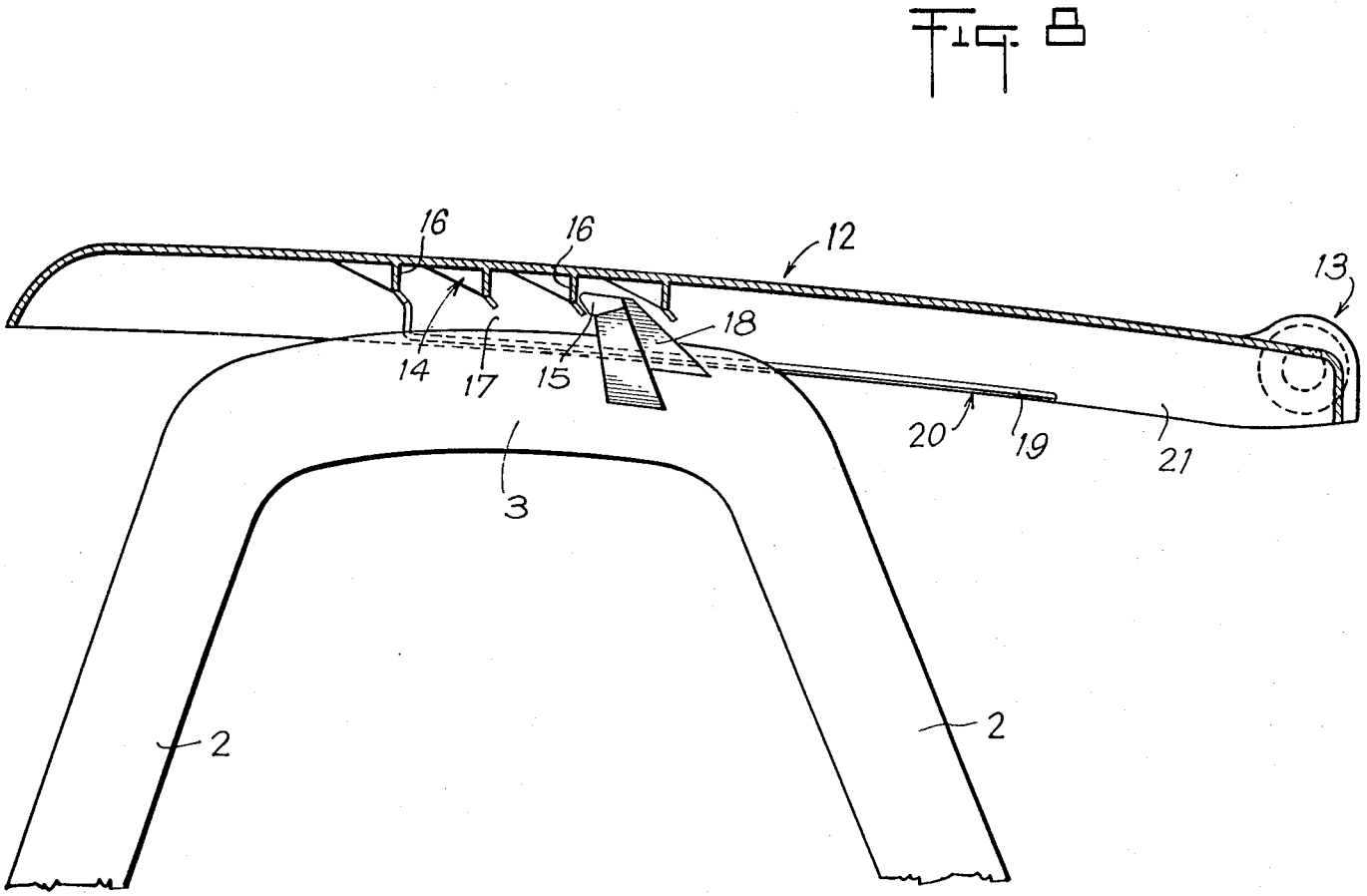
FIG. 8 is an elevation view in partial section on line VII—VII of FIG. 2, but on a larger scale.

The hinge devices 13 are designed, as shown in FIGS. 5 too 7, so that:

the back 4 is free to pivot in the direction of arrow F1 (FIG. 5) so as to move the arm rests 12 fully forwards while simultaneously pivoting said arm rests a little about a substantially horizontal axis (arrow F2) at the hinge devices 13 so that at the end of the forwards stroke the arm rests release internal racks 14 from fingers 15 on the corresponding ties 3, as described in greater detail below with reference to FIG. 8;

each arm rest 12 which normally extends flat over the corresponding tie 3 in a forwards and backwards direction is capable of pivoting in the direction of arrow F2 (FIG. 5) about the above-mentioned substantially horizontal axis in order to rise somewhat and disengage itself from the corresponding fingers 15;

each arm rest 12 can then be pivoted horizontally following arrow F3 (FIG. 6) about a substantially vertical axis by virtue of the hinge device 13 until it extends rearwards rather than forwards along a direction which is substantially parallel to the tie 3 between the corresponding pair of legs; and each arm rest 12 can then pivot in the direction of arrow F4 (FIG. 6) about the above-mentioned substantially horizontal axis in order to press flat against the slats 8 of the back 4 adjacent to the corresponding risers 5.

Figure 7:
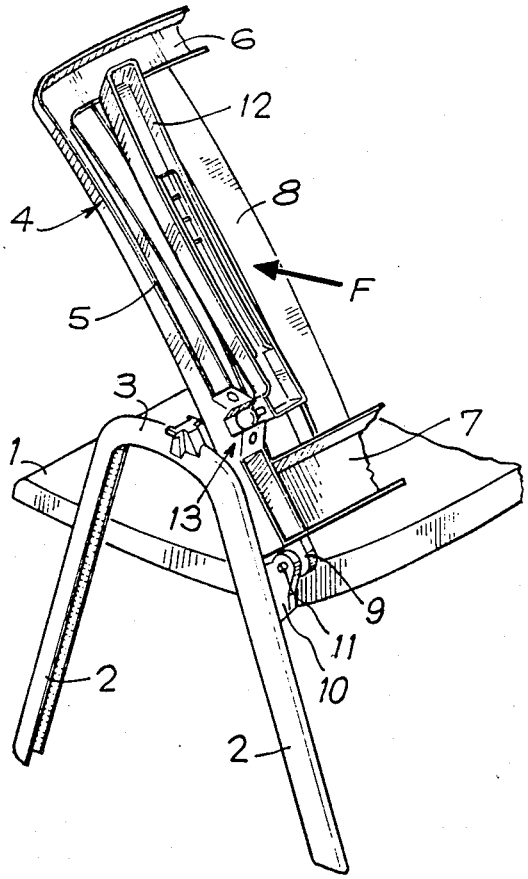

In the resulting position as shown in FIG. 7, the arm rests 12 do not project outside the back 4 so the total thickness of the assembly 12, 4 is kept to a minimum. Under such conditions, when the back is folded down onto the seat 1 with the arm rests 12 folded against the back, then the assembly 12, 4 does not impede stacking in practice (see FIG. 4), and as a result the stacking can be particularly close-packed, i.e. the stacking pitch can be very small.

The above description shows that each hinge device 13 must include at least two pivot axes, a horizontal axis and a vertical axis, and each arm rest 12 must be capable of being maneuvered around the corresponding riser 5 of the back through at least 180° so as to occupy a position in front of and outside the riser when in use, whereas it occupies a position behind and inside the back when in the retracted position, i.e. occupying a position above the back when the back is folded down into the seat. Each hinge device 13 is thus disposed behind the corresponding riser 5 of the back and projects far enough depending on the embodiment selected.

Two embodiments for the hinge devices 13 are shown in FIGS. 9 to 12. However before they are described, the adjustable connection between each arm rest 12 and the corresponding tie 3 is described.

Each arm rest 12 is a generally channel-section member having regularly spaced-apart transverse ribs 16 projecting inwardly from its top surface, thereby constituting the teeth of the above-mentioned rack. Beneath the rack, the arm rest delimits a passage 17 for receiving above-mentioned fingers 15. Such fingers project from either side of a tab 18 which is integrally molded with the ties between the legsin a pair of legs. The sides of the arm rests are integrally formed with two lips 19 delimiting a slot 20 giving access to the passage. While the longitudinal position of the arm rest is being adjusted, thereby adjusting the tilt of the back, the tab 18 lies between the lips 19 with th arm rest 12 being raised so that the projecting end portions of the fingers 15 rest against the lips, thereby leaving the fingers inside the passage 17 but disengaging the rack 14.

In this position, the arm rest is held prisoner by the fingers 15 but is free to move in translation while being guided by the lips 19. Once a desired position has been reached, the arm rest can be allowed to fall so that the fingers 15 engage a selected one of the ribs 16 of the rack 14.

In the vicinity of the hinge device 13, the lips 19 are interrupted and the sides of the arm rest 12 leave a passage 21 which is wide enough to allow the pair of fingers 15 to escape from the arm rests. Thus, when the chair is folded, the arm rests 12 are pulled forwardly and at the end of the forward stroke they are raised so as to release the fingers 15 through the passages 21. Thereafter, the procedure for folding back the arm rests as described with reference to FIGS. 5 to 7 can take place.

Figure 10:
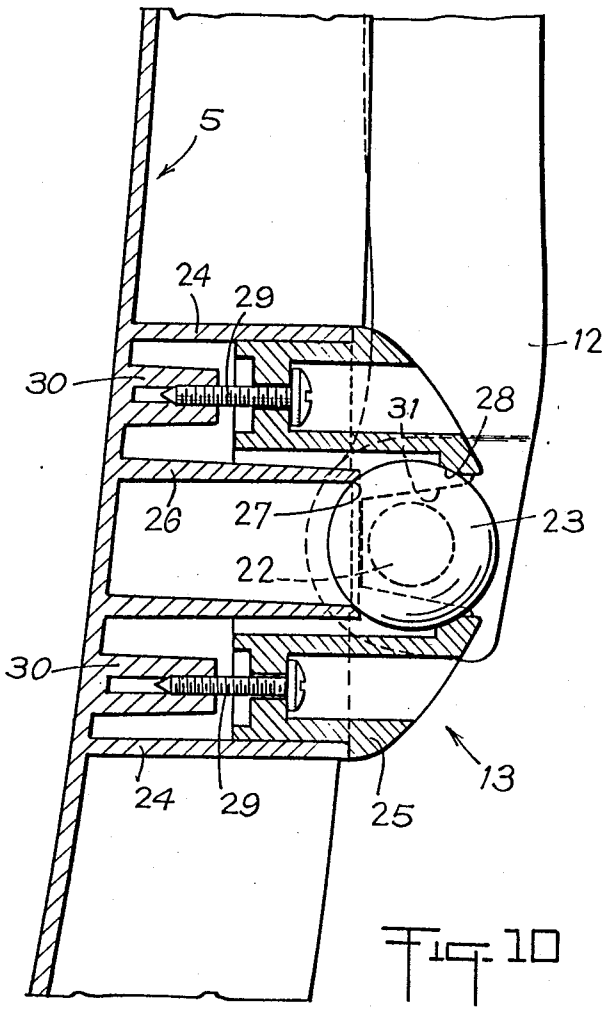
FIG. 10 is a section on line X—X of FIG. 9.
Figure 9:
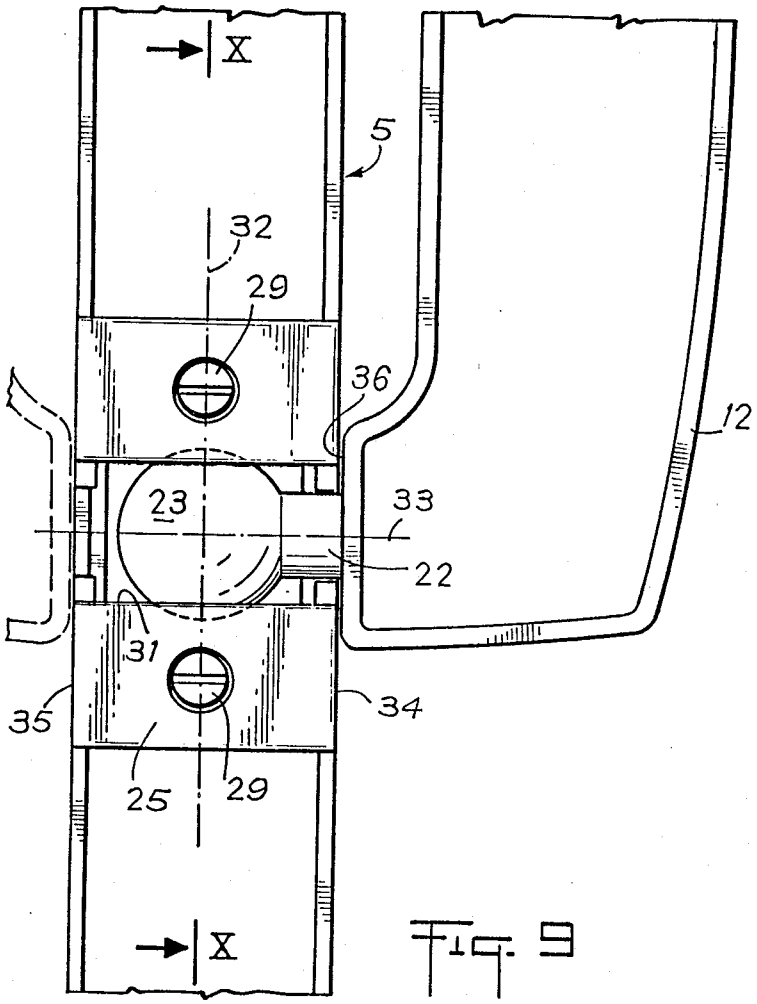
FIG. 9 is a rear view in the direction of arrow F in FIG. 7, but on a larger scale, showing a first embodiment of a device for hinging the left arm rest to the corresponding riser of the back.

In a first embodiment of each hinge device 13 as shown in FIGS. 9 and 10, each arm rest 12 is integrally molded with a rod 22 projecting inwardly near to its rear end and extending along a direction which is substantially perpendicular to its longitudinal axis, with the end of the rod being terminated by a ball 23.

The corresponding riser 5 of the back is integrally molded with a bearing body 24 which receives a cover 25 likewise made of molded plastics material. A tube 26 projects inside the body 24 so that its annular end constitutes a seat 27 for the ball 23 which is pressed against said seat by a bearing surface 28 on the cover 25. The ball 23 is held prisoner in the bearing 24, 25 by virtue of the cover 25 being fixed to the body 24 by means of screws 29 which are received in posts 30 integrally molded with the back. These screws are disposed on either side of a slot 31 provided through the cover 25 in order to allow the rod 22 to pivot about the longitudinal axis 32 of the riser 5 of the back through about 180°.

By virtue of such pivoting, the arm rests may occupy either the above-mentioned inside position shown in solid lines in FIG. 9 or else an outside position shown in dashed lines. In each of these positions, pivoting of the ball 23 is limited to pivoting about a transverse axis 33 perpendicular to the axis 32 and parallel to the pivot pins 11 on which the back is pivoted, given that the sides 34 and 35 of the bearing 24 and 25 comes into abutment against the corresponding side surface 26 of the arm rest 12. When the arm rest is in its outside position (dashed lines) such pivoting about the axis 33 makes it possible to put the arm rest on the corresponding tie 3 of the corresponding pair of legs and, when the arm rest is in its inside position (solid lines) such pivoting makes it possible to press the arm rest against the rear face of the slat 8 of the back 4.

Figure 12:
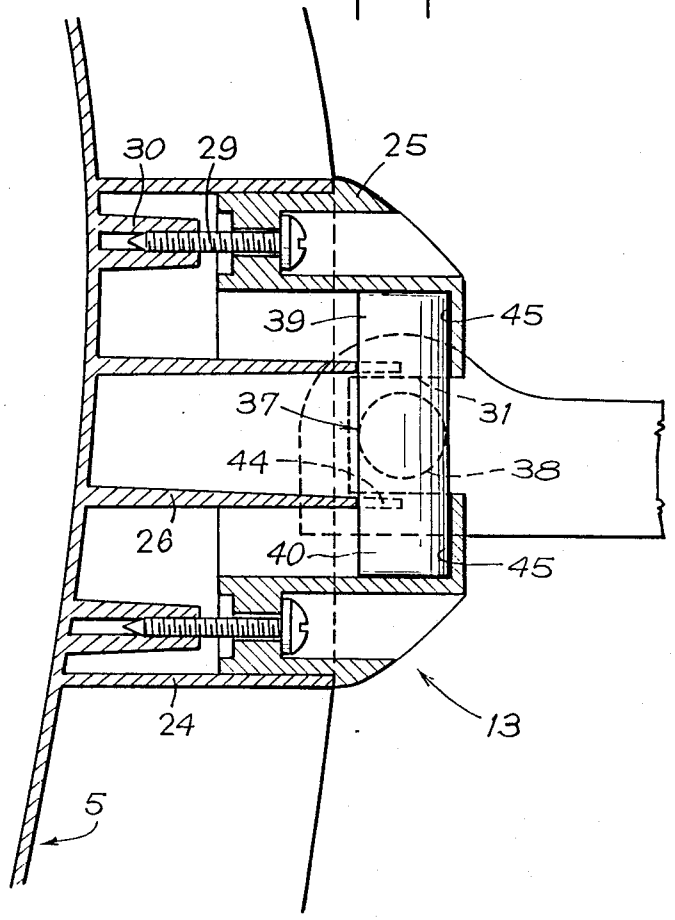
FIG. 12 is a section view on line XII—XII of FIG. 11.
Figure 11:
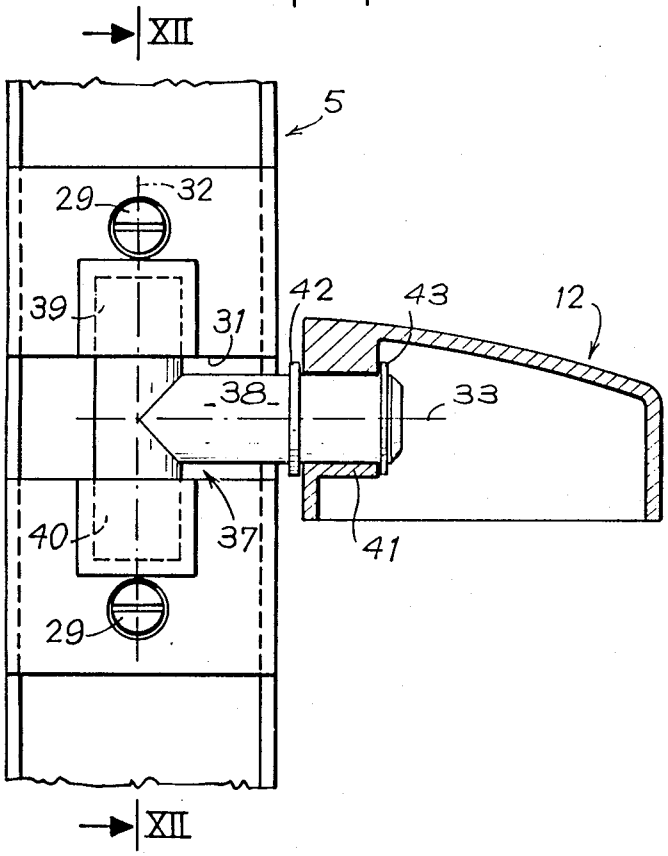
FIG. 11 is a view similar to FIG. 9 showing a second embodiment of a hinge device for the left arm rest.

In the second embodiment shown in FIGS. 11 and 12, each hinge device 13 comprises a solid T-shape 37 including a single stub axle 38 extending along the above-mentioned transverse axis 33, and two other stub axles 39 and 40 which are aligned with each other along the above-mentioned longitudinal axis 32.

The single stub axle 38 is rotatably received in a sleeve 41 integrally molded with the arm rest 12 and it is prevented from moving axially therein by virtue of a flange 42 and a removable spring clip ring 43.

The pair of stub axles 39 and 40 are rotatably received and preventing from moving in translation in a bearing which is constituted, as for the first embodiment, by a body 24 integrally molded with the corresponding riser 5 of the back 4 together with a cover 25 made of plastics material. The cover is fixed on the body by means of screws 29 received in posts 30 on the riser. The free end of the tube 26 in this bearing provides a cylindrical seat 47 while the cover delimits semicylindrical bearing surfaces 45 on either side of the slot 31 for passing the stub axle 38, with the stub axles 39 and 40 being guided between the seat 44 and the bearing surfaces 45.

I claim:

1. A chair comprising:

a seat;

two pairs of legs supporting the seat on respective sides thereof, with the legs in each pair converging upwardly and being interconnected above the seat by a respective top tie;

an arm rest displaceable longitudinally on each tie and adjustable in position thereon by means of a co-operating rack and stop finger;

a back pivotally mounted to the seat;

two two-axis hinge devices connecting the back to each of the two arm rests, respectively, with a first axis of each hinge device extending substantially along the line of greatest slope of the back and with the second axis of each hinge device being substantially perpendicular to the first axis and parallel to the axis about which said back is pivotally mounted to said seat;

each hinge device being disposed behind the back on a marginal member thereof, and projecting far enough to enable the corresponding arm rest to pass from an outside position relative to said marginal member to an inside position relative thereto by pivoting about said first axis, said inside and outside positions being substantially 180° apart; and each arm rest being capable, at least when in each of said outside and inside position, of pivoting about said second axis, thereby enabling said arm rest, when in its outside position, to engage on th corresponding tie when the back is in its raised position, and enabling said arm rest, when in its inside position, to be pressed flat against the rear face of the back until the back rests against the seat.

2. A chair according to claim 1, wherein in order to constitute each hinge device, the corresponding arm rest is formed with a rod projecting laterally in a direction which is substantially perpendicular to its longitudinal axis, said rod being terminated by a ball which is mounted to rotate about its own center in a bearing on the above-mentioned margin member of the back, said bearing delimiting a slot extending along the second above-mentioned axis so that the rod is guided and thereby limiting pivoting of the ball about the first axis, whereas the sides of said bearing are suitable for co-operating with the corresponding side of the arm rest under consideration by coming into abutment therewith, thereby limiting pivoting of the ball about the second axis.

3. A chair according to claim 2, wherein each ball and rod are integrally molded with the corresponding arm rest of plastics material.

4. A chair according to claim 2, wherein each ball rests on a seat-forming tube of the bearing and is held captive pressed against said seat by a cover molded from plastics material, said cover delimiting the above-mentioned slot and being applied to the bearing surface of the body of the bearing and being fixed to said body on either side of said slot, preferably by means of screws, with the body and the tube being integrally molded with the back made of plastics material.

5. A chair according to claim 1, wherein the hinge device comprises a solid T-shape having a single stub axle constituting the second axis and rotatably mounted in a sleeve integrally molded in the corresponding arm rest of plastics material and held in said sleeve against movement in translation, and further comprising two other stub axles which are aligned with each other along the first axis and are rotably mounted in a bearing constituted by a body integrally molded with the above-mentioned margin member of the back made of plastics material and by a cover which is fixed to the body, in particular by means of screws, with the cover of plastics material delimiting the above-mentioned slot and with the aligned stub axles being prevented from moving in translation relative thereto.

* * * * *